United States Patent [19]

Omori

[11] 4,168,598

[45] Sep. 25, 1979

[54] VACUUM PACKAGING METHOD AND APPARATUS

[75] Inventor: Shozo Omori, Tokyo, Japan

[73] Assignee: Omori Machinery Co., Ltd., Tokyo, Japan

[21] Appl. No.: 880,161

[22] Filed: Feb. 22, 1978

[30] Foreign Application Priority Data

| | | | |
|---|---|---|---|
| Mar. 1, 1977 | [JP] | Japan | 52-20864 |
| Mar. 25, 1977 | [JP] | Japan | 52-35557[U] |
| Mar. 29, 1977 | [JP] | Japan | 52-37363[U] |
| May 10, 1977 | [JP] | Japan | 52-52579 |
| May 21, 1977 | [JP] | Japan | 52-58218 |
| May 26, 1977 | [JP] | Japan | 52-61674 |
| May 30, 1977 | [JP] | Japan | 52-62208 |
| May 30, 1977 | [JP] | Japan | 52-69755[U] |

[51] Int. Cl.[2] ..... B65B 31/02

[52] U.S. Cl. ..... 53/433; 53/511

[58] Field of Search ..... 53/22 A, 112 A

[56] References Cited

U.S. PATENT DOCUMENTS

| | | | |
|---|---|---|---|
| 3,645,065 | 2/1972 | Jensen et al. | 53/112 A X |
| 3,835,618 | 9/1974 | Perdue | 53/112 A |
| 4,034,536 | 7/1977 | Mahaffy et al. | 53/112 A X |

*Primary Examiner*—Travis S. McGehee

*Attorney, Agent, or Firm*—Wenderoth, Lind & Ponack

[57] ABSTRACT

Upper and lower continuous films are supplied intermittently, with the upper film being supplied in a direction to form an acute angle relative to the advancing direction of the lower film. A part of the upper film is made soft and expansible by heating and is pressed upon the lower film while both films are stopped from advancement in such a manner that the softened part of the upper film encloses a material on the lower film. The space between the upper and lower films and about the material is then vacuumized. An upper vacuum box having a lower open end is provided above the upper film and has heating means and vacuum suction means therein. The upper vacuum box is moved to an inclined position, in which the lower end of the vacuum box becomes parallel to the upper film, and is then descended to a position, in which the upper film is pressed upon the lower film by the lower end of the vacuum box.

17 Claims, 14 Drawing Figures

VACUUM PACKAGING METHOD AND APPARATUS

BACKGROUND OF THE INVENTION

This invention relates to a method and apparatus for packaging a material between upper and lower films by vacuumizing a space about the material therebetween.

Some of the known methods and apparatus of this type are shown in Japanese patent applications laid-open under Nos. 49-95782 and 49-111786 and Japanese utility model publication No. 48-3022. In any one of these methods and apparatus, a material or materials to be packaged are placed on a lower film or paper on a pedestal which is provided inside of a lower chamber to be movable upwardly and downwardly. The lower chamber has an upper open end which is adapted to be closed by a lower open end of an upper chamber with an upper film interposing between the open ends of the upper and lower chambers. The upper chamber has a heating means therein for softening the upper film by heat to make it expansible.

In such structure, after softening the upper film by heating, the pedestal is moved up while the interior of the upper and lower chambers are being vacuumized. Due to the upward movement of the pedestal, the material thereon contacts the lower surface of the upper film and then expands it upwardly until the peripheral portion of the upper film encloses the material and attaches to the lower film or paper on the pedestal by vacuum suction. After enclosing the material by the upper and lower films, the packaged material is taken out by lifting the upper chamber upwardly to separate from the lower chamber.

In these methods and apparatus set forth above, it has usually been required to place the material or materials to be packaged on the pedestal and also to remove the packaged material or materials from the pedestal by manual operations. Accordingly, it was quite difficult to put the above known packaging methods and apparatus into an automatic production line which automatically conveys the material to be packaged on the lower film and finally discharges the packaged materials as final products.

Another serious problem has been experienced in such known methods and apparatus when it was intended to package a frozen or refrigerated material. Because, when the frozen material is moved up against the upper film to expand the latter, the upper film is cooled immediately at the surface thereof contacted by the frozen material, so that small wrinkles are formed on the upper film of the packaged material to deteriorate the appearance thereof.

As an automatic vacuum packaging method and apparatus, it is known, as shown in U.S. Pat. No. 3,189,505, to provide a number of upper and lower molding members connected to upper and lower endless belts, respectively, in order that each of the upper and lower molding members can be moved synchronously with each other. When upper and lower films are supplied continuously into the packaging process or device with a material to be packaged being on the lower film at predetermined intervals, the upper and lower molding members contact the upper and lower films, respectively, and enclose the material between the upper and lower films and also between the upper and lower molding members. Thus, the materials placed on the lower film are enclosed by the upper and lower molding members successively in turn and conveyed forwardly by the movement of the endless belts, during which a vacuumizing process is carried out in each of the enclosed molding members in synchronization with a rotary valve connected to a vacuum source.

Such a known method and apparatus set forth directly above has an advantage that vacuum packaging can be made by continuously supplying the upper and lower films with the materials to be packaged being on the lower film at predetermined intervals.

However, due to the continuous operation, this method is very complicated, and also the apparatus for carrying out the method is vary large and expensive.

SUMMARY OF THE INVENTION

Accordingly, an object of the present invention is to provide an automatic vacuum packaging method and apparatus which are simple in operation and structure, the apparatus being expensive to manufacture.

Another object of the present invention is to provide a vacuum packaging method and apparatus suited for packaging materials projecting upwardly above a lower film.

A further object of the present invention is to provide a vacuum packaging method and apparatus which can very closely attach an upper film about a material on a lower film.

Still another object of the present invention is to provide a vacuum packaging method and apparatus which can easily and effectively vacuumize a space about the material to be packaged between upper and lower films.

Another object of the present invention is to provide a vacuum packaging method and apparatus which can closely enclose frozen or refrigerated material on the lower film without forming any wrinkles on the upper film.

According to the present invention, a vacuum packaging method comprises the steps of supplying a continuous lower film intermittently, placing materials to be packaged upon the lower film, supplying a continuous upper film intermittently in a direction to form an acute angle relative to the advancing direction of the lower film, the upper film having the characteristic of being expansible when softened by heat, heating a part of the upper film to form a softened part on the upper film, pressing the upper film onto the lower film while both films are stopped from advancement in such a manner that the softened part of the upper film encloses the material on the lower film, and vacuumizing a space about the material between the upper and lower films.

Preferably, the heating step is carried out by sucking the part of the upper film to be softened upwardly under vacuum, the vacuum being released when the space around the material is vacuumized.

More preferably, the sucked part of the upper film is expanded upwardly while the part is heated, the expanded part of the upper film having a shape slightly larger than that of the material on the lower film.

A vacuum packaging apparatus according to the present invention comprises means for supplying a continuous lower film intermittently, upon which a material to be packaged is placed, means for supplying a continuous upper film intermittently in a direction to form an acute angle relative to the advancing direction of the lower film, the upper film having the characteristic of being expansible when softened by heat, an upper vacuum box provided above the upper film and opened at the lower end thereof, the upper vacuum box having a heating means and a vacuum suction means therein, means for moving the vacuum box to an inclined position, in which the lower end of the vacuum box becomes parallel to the upper film, and descending the vacuum box to a position, in which the upper film is pressed upon the lower end of the vacuum box, and means for vacuumizing a space about the material between the upper and lower films.

Preferably, the heating means in the upper vacuum box comprises a stationary heating element and a movable heat plate. The heat plate is allowed to take a lower position, in which the lower surface thereof is substantially on the same level as the lower end of the upper vacuum box, and an upper position, in which a hollow space large enough to cover the material to be packaged is formed inside of the upper vacuum box.

Further objects and features of the present invention will become apparent from the detailed description of preferred embodiments thereof when taken in conjunction with the accompanying drawings, in which:

DETAILED DESCRIPTION OF THE INVENTION

Figure 1:
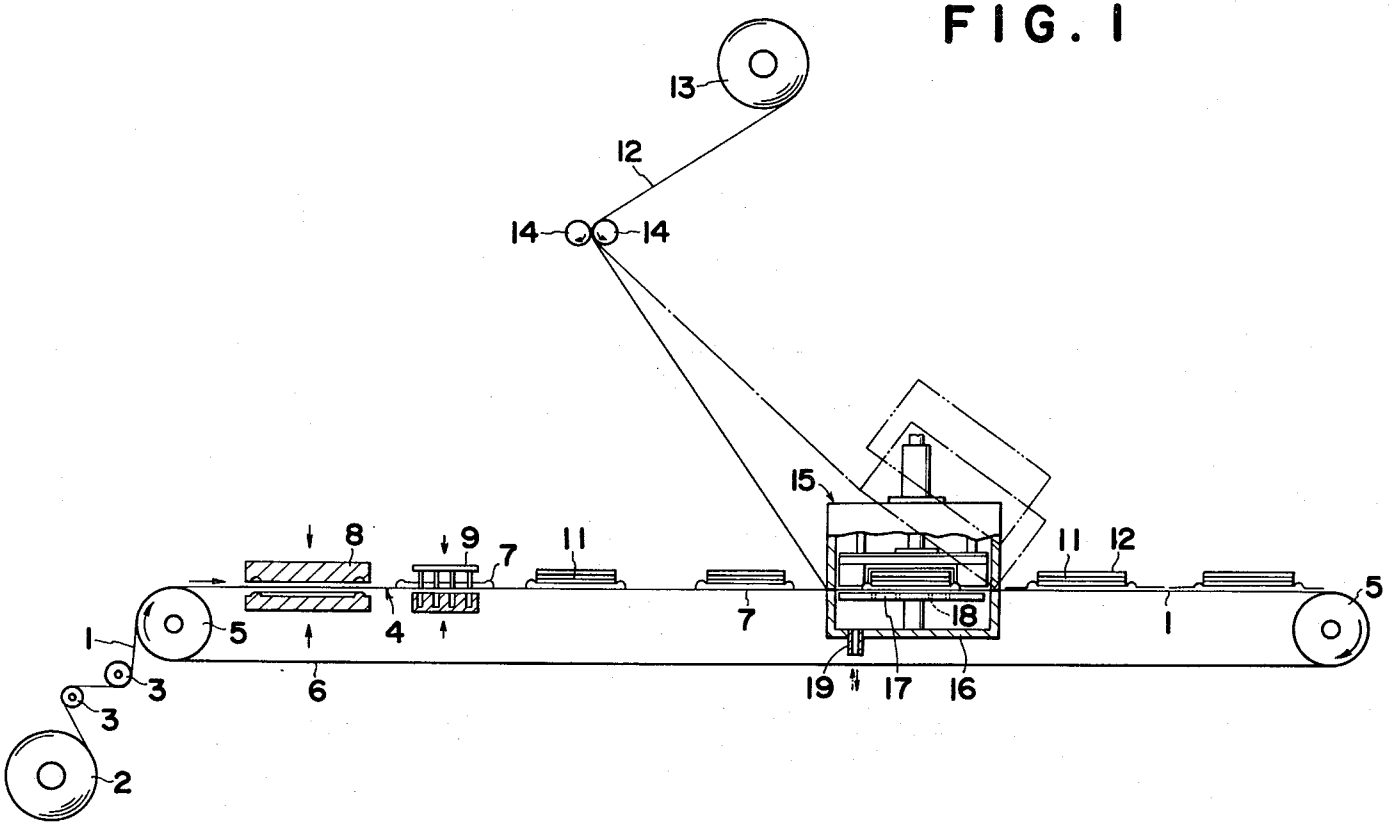
FIG. 1 is a schematic side view showing an apparatus according to a preferred embodiment of the present invention.

Referring now to a vacuum packaging method and apparatus shown in FIG. 1, a thermoplastic lower film 1, such as polyethylene or polypropylene film, wound on a roll 2 is removed therefrom through guide rollers 3 and then supplied onto a conveyor 4. The conveyor 4 has a pair of driving rollers 5 around which a pair of endless chains 6 are provided. The driving rollers 5 are driven intermittently by a known method to allow the vacuum packaging method to be performed intermittently as described hereinafter. The lower film 1 supplied onto the conveyor 4 is clamped at both ends or edges thereof by clamping members on the endless chains 6 as is known and is conveyed forwardly together with the movement of the endless chains 6.

The lower film 1 is first formed with an upwardly projecting platform 7 by a pair of known heated molds 8 while the conveyor 4 stops moving. This platform 7 is formed to receive materials to be packaged thereon, but it may be any shape or can be omitted.

Figure 2:
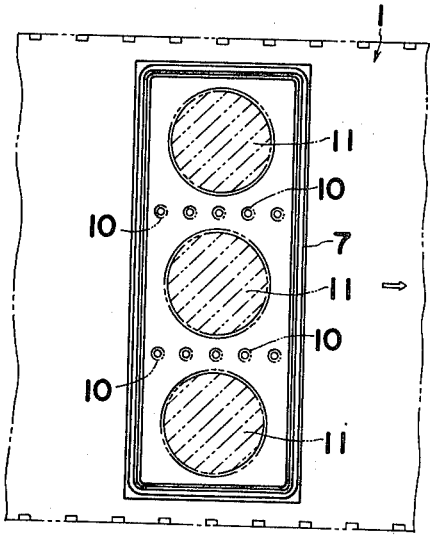
FIG. 2 is a plan view showing a part of a lower film in FIG. 1 formed with a platform and punched to make vacuumizing holes.

When the lower film is further advanced for a predetermined distance, a punching machine 9 moves down onto the formed platform 7 while the movement of the lower film stops again. The punching machine 9 forms series of small holes 10 through the platform 7 at intermediate portions between the materials to be placed thereon, as shown in FIG. 2.

The lower film 1 is further advanced for a predetermined length where materials 11 to be packaged are placed automatically or manually on the platform 7 in such a manner that the materials 11 do not close the punched holes 10. The materials 11 to be packaged may be any kind of solid materials but, in this embodiment, these are frozen slices of ham piled to a predetermined height.

Then, the materials on the lower film 1 are advanced together with the lower film and subjected to the present vacuum packaging at the next stage while they are stopping. In this stage, a continuous upper film 12 is supplied from a roll 13 through guide rollers 14—14 in a direction to form an acute angle relative to the advancing direction of the lower film 1. This upper film has the characteristic of being expansible when softened by heat and is usually made of plastic film of vinylidene chloride.

Provided above upper film 12 is an upper vacuum box 15, and also provided below the platform 7 of the lower film 1 is a lower vacuum box 16. The lower vacuum box 16 is open at the upper end thereof and has a supporting plate 17 therein to receive the lower film 1 as well as the platform 7 on the same level as the upper end of the lower vacuum box 16. The plate 17 has series of small holes 18 therethrough which are adapted to be registered with the holes 10 in the platform when the platform 7 comes onto the plate 17 and is stopped thereon. The lower vacuum box 16 also has an opening 19 connected with a vacuum source through a relevant regulating valve (not shown).

The upper vacuum box 15 is open at the lower end thereof and is movable from the uppermost inclined position shown by the two-dot-dash lines to the lower closing position shown by solid lines by way of an intermediate inclined position shown by the single dot-dash lines in FIG. 1. The upper vacuum box 15 is separated in parallel from the upper film 12 at the uppermost inclined position but comes into contact with the upper film 12 at the lower end thereof at the intermediate inclined position. When the upper vacuum box 15 descends from the intermediate inclined position to the lower position, the upper film 12 is pulled out of the roll 13 and covers the material 11 on the lower film 1 at the inside of the upper vacuum box 15. Thereafter, the upper film advances together with the lower film 1 and packages the material 11 therebetween.

Figure 3:
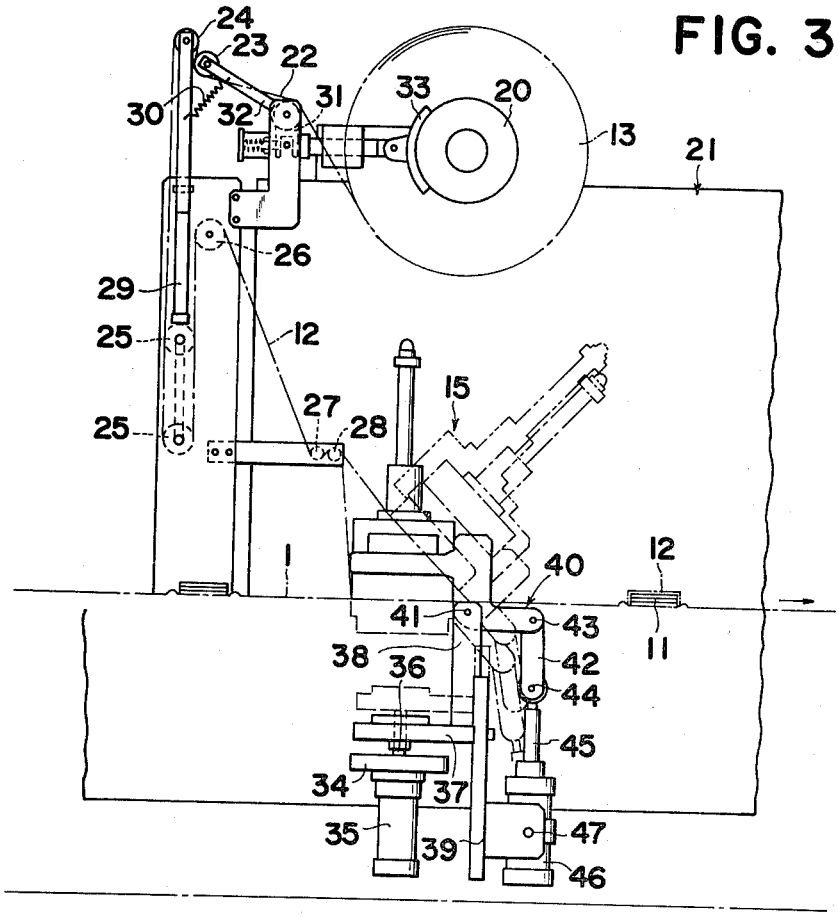
FIG. 3 is a schematic side view showing devices for drawing out an upper film intermittently and for moving an upper vacuum box shown in FIG. 1, FIGS. 4 (A) and 4 (B) are vertically sectioned side views each showing the structure of the upper vacuum box shown in FIG. 1, in which a movable heat plate is moved up in FIG. 4 (A) but moved down in FIG. 4 (B)

Reference is now made to the structure for moving the upper vacuum box 15 up and down and also to the structure for pulling or drawing out the upper film 12 from the roll 13 by the movement of the upper vacuum box 15, with reference to FIG. 3. The roll 13 of the upper film 12 is supported on a rotary shaft 20 which is secured to a machine frame 21. The upper film 12 extends from the roll 13 through a guide roller 22, tension roller 23, guide roller 24, extension roller 25 and guide roller 26, 27 and 28 toward the lower side of the upper vacuum box 15. When the extension roller 25, at the upper position shown in FIG. 3, is moved down to the lower position shown in FIG. 3 by means of a first air cylinder 29, the tension roller 23 is moved up by the tension of the upper film 12 against a tension spring 30, whereby the upper film is drawn out of the roll 13 for a predetermined length. At the same time, the upper film 12 at the lower side of the upper vacuum box 15 is stretched and comes close to the lower end of the upper vacuum box 15. On the other hand, when the extension roller 25 is moved up to the upper position shown in FIG. 3, the tension having been applied to the upper film 12 is released to slacken the film, so that the tension roller 23 returns to the original position due to the tension of the spring 30. Accordingly, bifurcated legs 31 connected to the lower end of an arm 32 of the tension roller 23 push a brake shoe 33 against the rotary shaft 20 to prevent the upper film from being drawn out.

Provided at the lower part of the machine frame 21 is a device for ascending and descending the upper vacuum box 15. The device comprises a stationary plate 34 secured to the machine frame 21 for supporting a second air cylinder 35. The second air cylinder 35 has a piston rod 36 provided with a movable plate 37, on which a movable supporting plate 38 and a connecting plate 39 are fixed. The supporting plate 38 is pivotably connected at the upper end thereof with the lower center part of an angled arm 40 by a pin 41. The angled arm 40 is directly connected with the upper vacuum box 15 for moving the latter and is also connected at the forward lower end thereof with the upper end of a link 42 by a pivot pin 43. The link 42 is pivotably connected at the lower end 44 thereof with the upper end of a piston rod 45 of a third air cylinder 46 which in turn is pivotably connected at the center body portion thereof with the connecting plate 39 by a pin 47.

The upper and lower movements, i.e. ascending and descending movements, of the upper vacuum box 15 are effected by the second air cylinder 35 while the inclined movement of the upper vacuum box 15 is effected by the third air cylinder 46. That is, when the third air cylinder 46 is operated to shorten the piston rod 45, the angled arm 40 is rotated in the clockwise direction about the pin 41 to incline the upper vacuum box as shown by the dot-dash lines in FIG. 3. Thereafter, when the second air cylinder 35 is operated to increase the length of the piston rod 36 thereof, the angled arm 40 as well as the third air cylinder 46 are raised while maintaining the inclined position of the upper vacuum box 15 as shown by the two-dot-dash lines in FIG. 3, so that the upper vacuum box takes the uppermost inclined position.

While the upper vacuum box 15 is at the uppermost inclined position, the upper film 12 is under the stretched condition, as the extension roller 25 is at the lower position due to the action of the first air cylinder 29. While the upper film 12 is stretched, the upper vacuum box 15 partially descends to the intermediate inclined position by the action of the second air cylinder 35 and holds a part of the upper film against the lower film 1 at the lower forward open end of the upper vacuum box 15. Then, the third air cylinder is operated to increase the length of the piston rod 45, so that the upper vacuum box 15 moves to the upright position as shown by the solid lines in FIG. 3. Soon after the upper vacuum box 15 takes the upright position, the first air cylinder 29 is operated to raise the extension roller 25, whereby the supply of the upper film 12 is stopped as set forth hereinbefore.

Figure 4A:
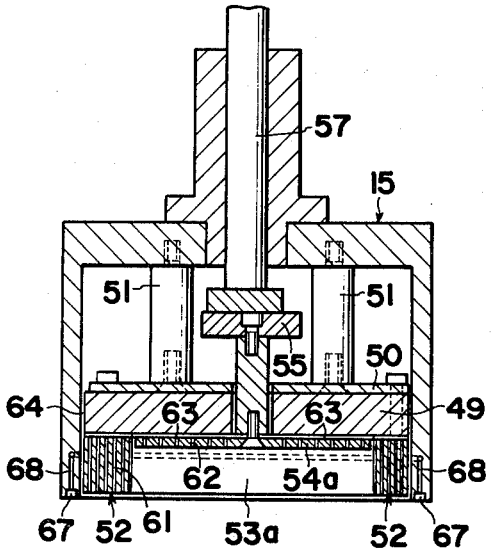
Figure 4B:
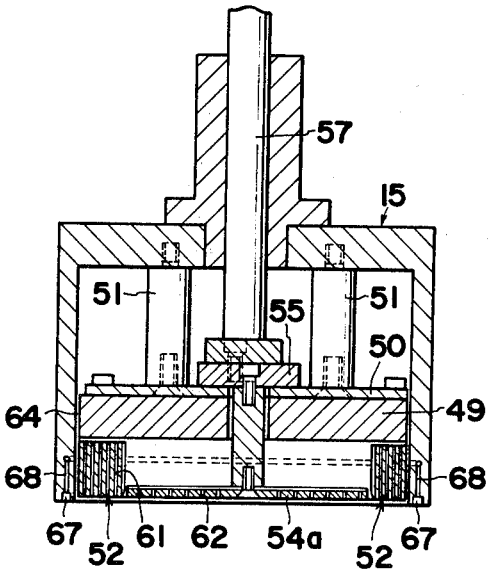
Figure 5:
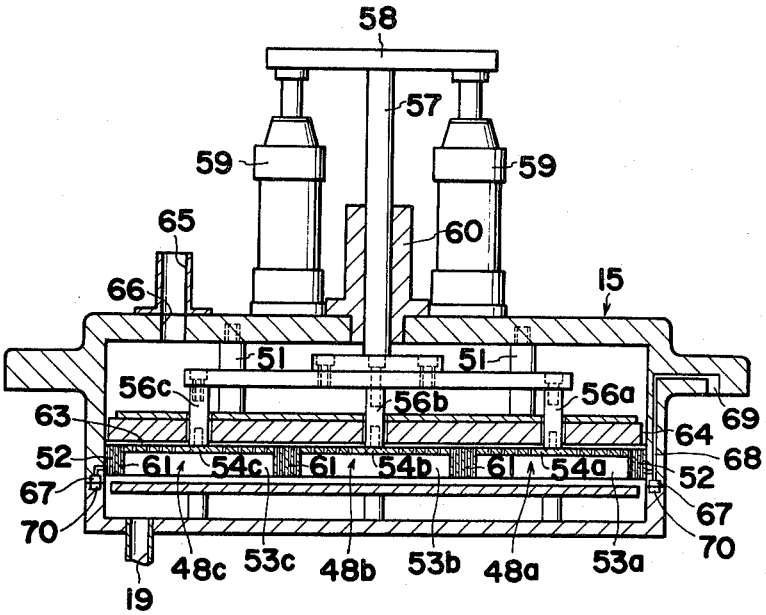
FIG. 5 is a vertically sectioned front view of the upper vacuum box shown in FIG. 4 (A) placed upon a lower vacuum box.

Referring now to the internal structure of the upper vacuum box 15 with reference to FIGS. 4 (A), 4 (B) and 5, the vacuum box 15 has three packaging sections **48*a*–48*c* in the transverse direction as shown in FIG. 5 for packaging three materials 11 on the lower film 1 simultaneously. The upper vacuum box is adapted to suck the upper film 12 under vacuum, to heat the sucked part for softening thereof, and to enclose the materials 11 on the lower film 1. At the interior of the upper vacuum box 15, a heating element 49 is provided which is secured to the lower surface of a plate 50 secured to the box 15 by connecting rods 51. The heating element may be any type of heat generating means such as a cartridge heater or a molded heater. Provided at the lower peripheries of the heating element 49 and at the lower intermediate portions thereof defining the packaging section 48*a*–48*c* are heat conductive members 52, the lower ends of which are at a level slightly higher than that of the lower open end of the upper vacuum box 15. The heat conductive members 52 may be made integral with the above mentioned heating element 49. The heat conductive members 52 are adapted to be slightly spaced from the upper film 12, when the upper vacuum box 15 takes an intermediate inclined position, and to heat the upper film portion below the heat conductive members 52 by transfer of heat from the heating element 49. Also provided at hollow spaces 53*a*–53*c* defined by the heating element 49 and the heat conductive members 52 in the upper vacuum box 15 are movable heat plates 54*a*–54*c*. Preferably, the heat conductive members 52 as well as the heat plates 54*a*–54*c*** are coated at the lower surfaces thereof with non-adhesive material such as Teflon (trade mark).

The movable heat plates are respectively connected to a supporting plate 55 by shafts **56*a*–56*c* extending through the heating element 49. The supporting plate 55 is connected at the center part thereof to the lower end of a vertical shaft 57, the upper end of which is connected to a connecting plate 58 which in turn is connected to air cylinders 59—59. The vertical shaft 57 extends through a guide flange 60 mounted to the upper surface of the vacuum box 15. Accordingly, when the air cylinders 59—59 are operated, the movable heat plates 54*a*–54*c* move up or down in the hollow spaces 53*a*–53*c*, respectively. When the movable heat plates 54*a*–54*c* are at the uppermost position, they contact the heating element 49 and each of the hollow spaces 53*a*–53*c* has dimensions slightly larger than the material 11 to be packaged on the lower film 1**.

Provided through the heat conductive members 52 and the movable heat plates **54*a*–54*c* are small passages 61 and 62, respectively, which are connected with each other by a horizontal passage 63 at the underside of the heating element 49 and then connected with a vacuum source through vertical passages 64 at the periphery of the heating element 49 and the shafts 56a–56c by way of a pipe 65 connected to an opening 66 in the upper vacuum box 15**.

The upper vacuum box 15 also has a rectangular groove 67 at the peripheral open end or edge thereof which is connected to a vacuum source through peripheral marrow passages 68 and an opening 69 at the flange of the upper vacuum box.

Provided at the open end of the lower vacuum box 16 opposite to the rectangular groove 67 is an elastic packing 70 such as rubber for sealing the upper and lower vacuum boxes 15 and 16 when the former is superimposed upon the latter.

Now, referring to the operation of the movable heat plates 54a–54c and vacuum packaging process, when the materials 11 on the lower film 1 are conveyed upon the supporting plate 17 in the lower vacuum box 16, the movement of the conveyor 4 stops. At this time, however, the upper vacuum box 15 is at the uppermost position and also the movable heat plates 54a–54c are at the uppermost positions in contact with the heating element 49 as shown in FIG. 4 (A). Then, the upper vacuum box descends to the intermediate inclined position and comes to contact with the inclined upper film at the lower end thereof, during which the movable heat plates 54a–54c come down substantially to the same level as the lower open end of the upper vacuum box 15 by the operation or actuation of the air cylinders 59—59, as shown in FIG. 4 (B). At the intermediate inclined position of the upper vacuum box 15, the rectangular groove 67 at the lower periphery of the upper vacuum box 15 is vacuumized through the peripheral narrow passages 68 and the opening 69 connected to the vacuum source, so that the upper film 12 is sucked against the lower end of the upper vacuum box 15. At the same time, the interior of the upper vacuum box 15 is vacuumized through the pipe 65 also connected to a vacuum source, so that the vacuum suction is applied to the upper film 12, which is grasped and heated by contacting the lower surfaces of the heat conductive members 52 and movable heat plates 54a–54c, through small passages 61 and 62 by way of the horizontal and vertical passages 63 and 64, respectively.

The upper film becomes soft and expansible when heated for a predetermined period of time, because the upper film is selected from a material having such characteristic. After the predetermined time has passed, the movable heat plates 54a–54c are moved up by the action of the air cylinders 59—59 while still grasping the softened upper film, so that the upper film is expanded upwardly along the hollow spaces 53a–53c, each of which are slightly larger in dimensions than the material 11 on the lower film 1.

Then, the upper vacuum box 15 rotates downwardly toward the lower vacuum box 16 until the lower open end of the upper vacuum box 15 is superimposed upon the upper open end of the lower vacuum box 16 with the upper and lower films therebetween. Thus, the materials 11 to be packaged are confined between the upper and lower films in the upper and lower vacuum boxes. But, since the dimensions of the hollow spaces 53a–53c in the upper vacuum box 15 are each slightly larger than the material 11 on the lower film 1, there remains a small air space between the upper film and the material. Then, the interior of the lower vacuum box 16 is vacuumized through the opening 19, which is communicated with the spaces about the materials 11 through the preliminary formed holes 10 in the lower film 1. At the same time or soon after the vacuumizing of the lower vacuum box 16, the interior of the upper vacuum box 15 is disconnected with the vacuum source and communicated with atmospheric pressure, so that the upper film softened under heating is closely attached to the materials 11 along the contours thereof and also to the lower film. Preferably, the interior of the upper vacuum box is communicated with pressurized air immediately after being disconnected from the vacuum source, so that the pressurized air applied to the upper film presses the latter to the material and more closely encloses the material.

Thereafter, the lower vacuum box is disconnected from the vacuum source. Then, the upper vacuum box 15 is raised to the uppermost inclined position to allow the further advancing of the vacuum packaged materials to the next stage, for example, for cutting and trimming into individual vacuum packaging to obtain final packaged materials.

According to such structure and operation of the upper vacuum box 15, since the movable heat plates 54a–54c contact and grasp the upper film 12 by suction and move film 12 upwardly while heating it, due to the upward movement of the heat plates 54a–54c, the expansion of the upper film 12 can be made precisely along the inner surfaces of the hollow spaces 53a–53c. Each of the hollow spaces 53a–53c has dimensions slightly larger than the material 11 on the lower film 1, whereby when the upper vacuum box 15 is closed over the lower vacuum box 16, there remains a narrow clearance or space between the upper film 12 and the material 11. Such narrow space allows the air about the material to be completely vacuumized through holes 10 in the lower film and the lower vacuum box 16, so that the upper film 12 is closely attached to the material 11 on the lower film 1 when the vacuum suction on the upper film is released. Further, such narrow space makes it possible to closely package frozen or refrigerated material without forming any wrinkles on the upper film, because the upper surface of the frozen material cannot contact the upper film to preliminary cool a part of the softened upper film, as is the case in prior art devices. In the present embodiment, the softened part of the upper film contacts and attaches to all of the surfaces of the material on the lower film almost simultaneously when the air around the material is vacuummized.

Figure 6:
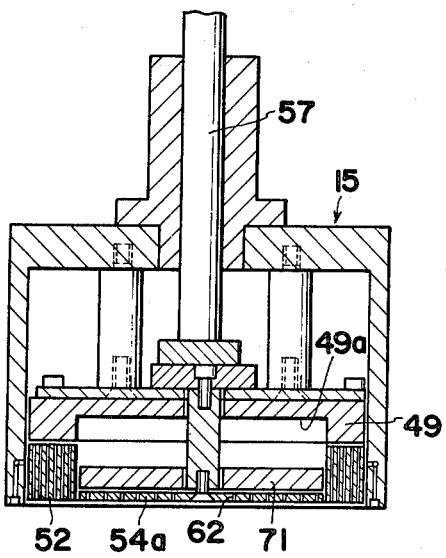
FIG. 6 is a vertically sectioned side view showing a modified structure of the upper vacuum box.

In the embodiment set forth above, the movable heat plates 54a–54c are made separately from the stationary heating element 49 to be heated thereby. However, the heat plates 54a–54c may have heat generating means 71 such as a cartridge heater or a molded heater mounted thereon to be movable therewith as shown in FIG. 6. In this case, the stationary heating element 49 has a recess 49a to snugly receive the heat generating means 71 therein when the heat plates 54a–54c as well as the heat generating means 71 are raised.

In the preferred embodiments set forth above, it has been shown that the movable heat plates 54a–54c contacting the upper film 12 at the lower position as shown in FIG. 4 (B) are moved upwardly while grasping the upper film by suction and moving the upper film upwardly. However, after sucking the upper film for positively heating the upper film 12 for a predetermined period of time at the lower position of the movable heat plates 54a–54c, the suction force to the upper film may be released when the heat plates move up by disconnecting the upper vacuum box 15 from the vacuum source. In this case, when the heat plates 54a–54c are moved the uppermost position as shown in FIG. 4 (A), the suction force is applied again to the upper film 12 through the small passages 62 by connecting the upper vacuum box with the vacuum source, so that the parts of the upper film having been softened by heating expand upwardly by the suction force along the inner surfaces of the hollow spaces 53a–53c and are grasped by the lower surfaces of the heat plates. Thereafter, the upper vacuum box 15 is placed upon the lower vacuum box 16 and then the vacuum suction force to the upper film is released when or soon after the vacuumizing of the space about the materials 11, as in the case of the above embodiment.

Figure 7:
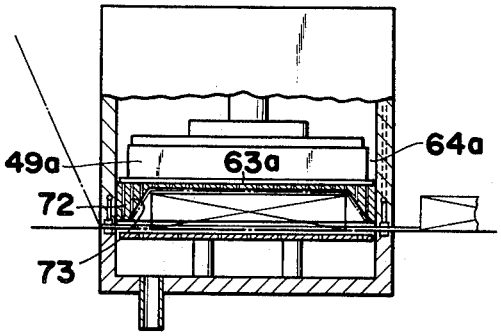
FIG. 7 is a vertically sectioned side view showing another modified structure of the upper vacuum box.
Figure 8:
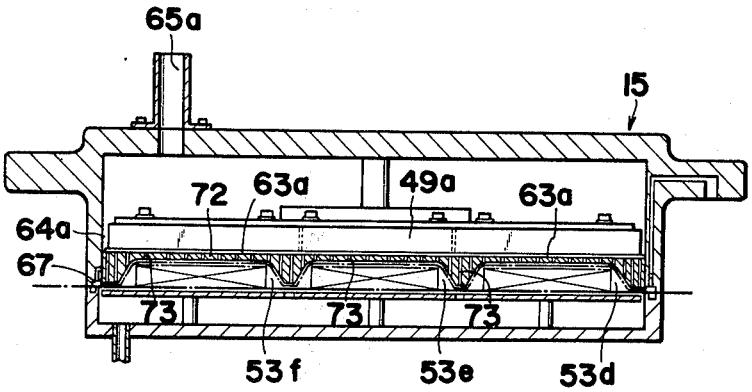
FIG. 8 is vertically sectioned front view of the upper vacuum box shown in FIG. 7 placed upon the lower vacuum box.

Another embodiment of the upper vacuum box 15 shall be described hereinafter with reference to FIGS. 7 and 8. In this embodiment, the movable heat plates 54a–54c shown in the preceding embodiments are omitted but, instead of them, heat conductive member 72 is provided at the entire inner peripheries defining each of the hollow spaces 53d–53f. Provided above the heat conductive member 72 is a heating element 49a of the same type as shown in the preceding embodiments. The heat conductive member 72 has a number of small vertical passages 73 which are adapted to be communicated with a vacuum source through horizontal passages 63a at the underside of the heating element 49a, vertical passages 64a at the periphery of the heating element 49a, and a pipe 65a. In this embodiment, also each of the hollow spaces 53d–53f has dimensions slightly larger than the material 11 to be packaged.

In operation of this embodiment, when the upper vacuum box 15 is at the intermediate inclined position, the upper film 12 is attached to the lower open end of the upper vacuum box 15 by the suction force applied thereto through regutangular grooves 67 also provided at the open end of the vacuum box 15 as in the case of the preceding embodiments. Then or at the same time, the suction force is applied also to the upper film through the small vertical passages 73 passing through the heat conductive member 72. Accordingly, the upper film softened by heating is expanded upwardly and attached to the inner surfaces of the heat conductive member 72 defining the hollow spaces 53d–53f. Thereafter, the upper vacuum box 15 is placed upon the lower vacuum box 16 and then the vacuum suction force to the upper film 12 is released when or soon after the vacuumizing of the space about the material as in the cases of the preceding embodiments.

Preferably, the upper film 12 is preliminarily heated by any additional heating means before it arrives at the upper vacuum-box.

Figure 9:
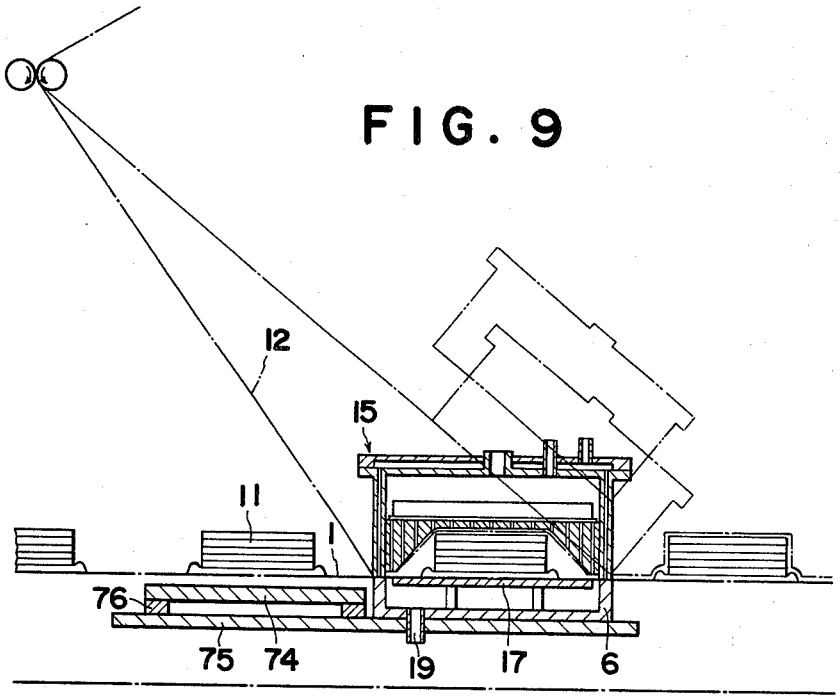
FIG. 9 is a vertically sectioned side view showing the upper and lower vacuum boxes with a preliminary heating means being attached to the lower vacuum box.

More preferably, there is provided a preliminary heating means for the lower film. FIG. 9 shows such preliminary heating means in which a heating plate 74 is mounted upon a supporting plate 75 by means of a spacer 76. The supporting plate 75 extends to the underside of the lower vacuum box 16 and is fixed thereto with the pipe 19 extending through the registered holes in the supporting plate 75 and the lower surface of the vacuum box 16. The upper surface of the heating plate 74 is located at a level slightly lower than the open upper end of the lower vacuum box 16, so that when the lower film 1 advances forwardly above the heating plate, the lower film 1 is preliminarily heated before coming to the upper portion of the lower vacuum box 16. Such preliminary heating of the lower film 1 facilitates close adhesion of the upper and lower films, because both films are softened by heating and can be selected from materials having characteristics enabling them to be adhered with each other when softened.

Figure 10:
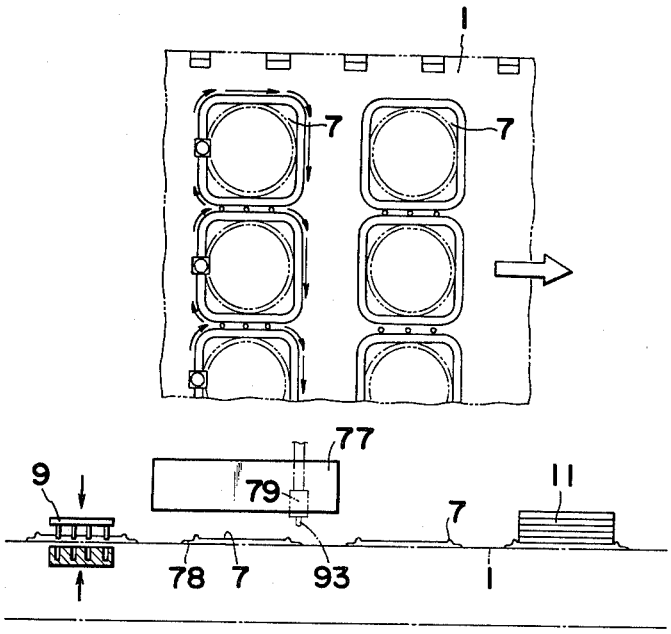
FIG. 10 is a schematic side view showing an adhesive agent coating step in a modified method of the present invention, in which a part of the lower film coated with the adhesive agent is shown in plan view.
Figure 11:
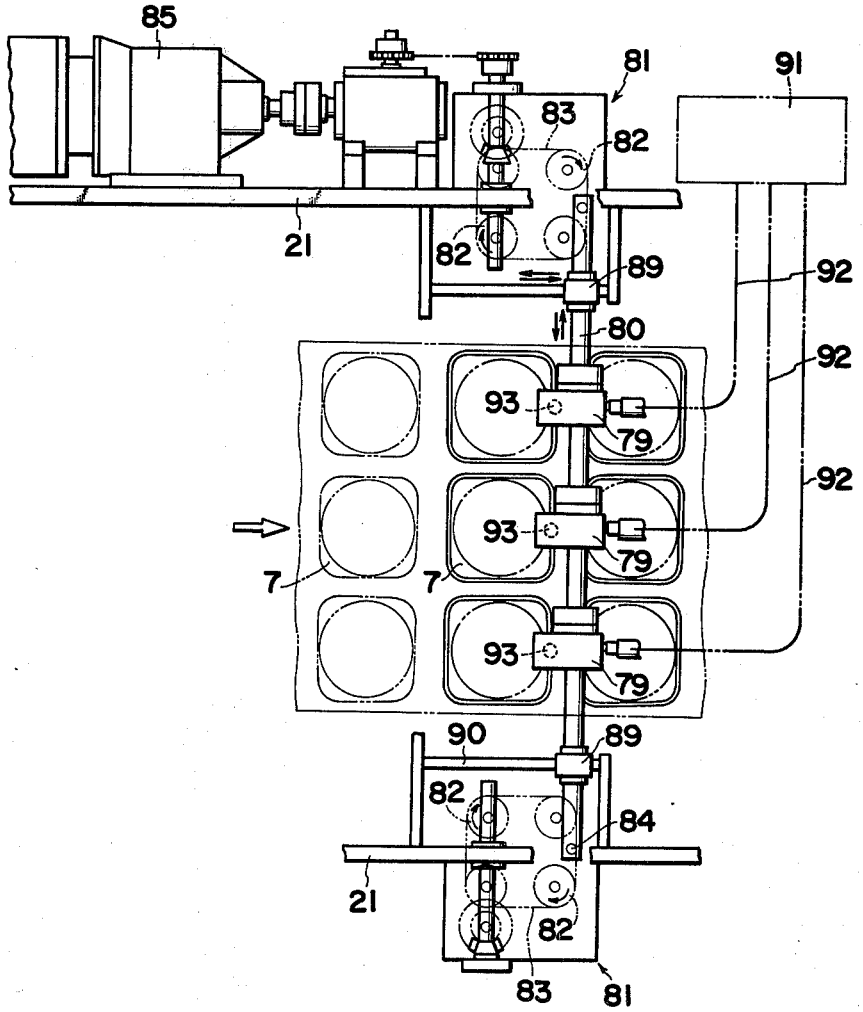
FIG. 11 is a plan view showing a device for coating the adhesive agent on the lower film.

In order to adhere both films 1 and 12 more positively and to allow the upper film 12 to be repeatedly peeled off from the lower film, for example for removing one slice of ham from a stack of slices, and for stocking the remaining slices into a refrigerator by closing the upper film again on the lower film, it is preferable to coat a pressure sensitive adhesive agent upon the lower film around the materials to be packaged. The coating of the pressure sensitive adhesive agent can be made after punching holes 10 in the lower film but before placing the materials 11 to be packaged on the lower film 1, as shown in FIG. 10. In FIG. 10, a device 77 for applying such adhesive agent 78 is shown as provided above the lower film 1. This device 77 shall be described in detail with reference to FIGS. 11 and 12.

Figure 12:
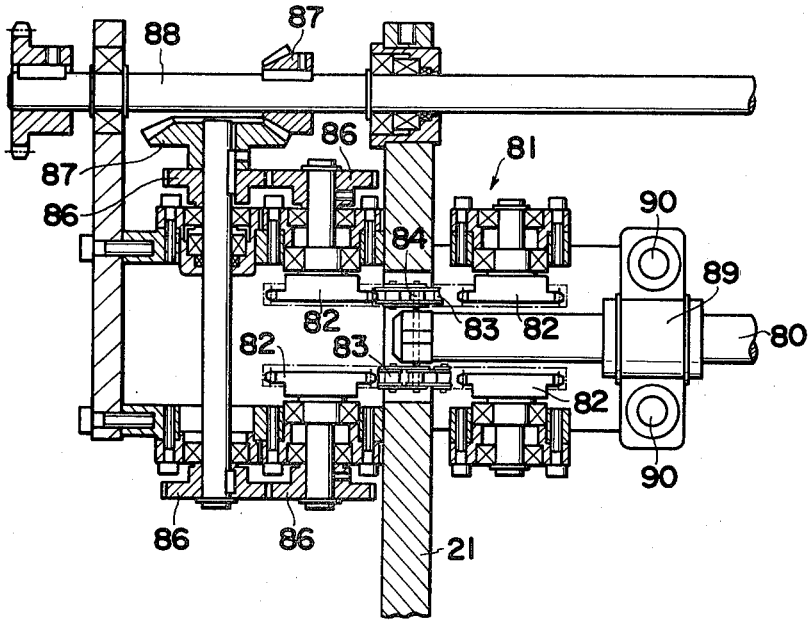
FIG. 12 is a schematically sectioned front view showing a driving means of the device shown in FIG. 11.

The device 77 comprises three ejectors 79 for the adhesive agent in the transverse direction of the lower film 1 because three platforms 7 are formed in the transverse direction of the lower film for placing three respective materials thereon. These ejectors 79 are mounted on a cross bar 80, both ends of which are connected to driving devices 81—81 provided at both sides of the lower film 1. Each driving device 81 has sprockets 82—82 and endless chains 83—83 engaging therewith to form a substantially rectangular configuration corresponding to that of the platform 7 on the lower film 1. The cross bar 80 is connected to the endless chains 83—83 by pins 84—84 at the both ends thereof. The sprockets 82—82 are operatively connected to a driving motor 85 through gears 86—86, bevel gears 87—87 and a shaft 88 as shown in FIG. 12. The cross bar 80 penetrates hollow bearings 89—89 to be slidable therethrough which are in turn slidably mounted upon shafts 90—90 secured on the machine frame 21. The adhesive agent is supplied to each of the ejectors 79—79 from a tank 91 through pipes 92 and applied on the lower film 1 around the platforms 7 from nozzles 93.

According to such a structure of the device 77 for applying the pressure sensitive adhesive agent, when the lower film 1 is stopped from further advancement with the platforms 7 on the lower film being at a predetermined position below the ejecting nozzles 93, the driving motor 85 is operated for rotating the shaft 88 thereof for a predetermined number of rotations. By rotation of the shaft 88, the sprockets 82—82 as well as the endless chains 83 are rotated. Accordingly, the cross bar 80 engaging with the endless chains 83 is moved in the transverse and lengthwise directions of the lower film by sliding through the hollow bearings 89—89 and also by the sliding movement of the hollow bearings on the shafts 90—90. Thus, the adhesive agent 78 is ejected along the outer peripheries of the platforms 7 on the lower film from the nozzles 93 of the ejectors 79 moving together with the cross bar 80.

In the above description of the driving devices 81—81 of the cross bar 80, though the sprockets 82 and endless chains 83 are employed, any other devices may be used, for example, rotary plates engaging with both end of the cross bar 80.

The lower film 1 thus coated with the adhesive agent is advanced to the next step where the materials 11 to be packaged are placed on the platforms 7 on the lower film 1. Then, the materials 11 are packaged between the upper and lower films under vacuum as described in the preceding embodiments. At the time of covering the upper film upon the materials under vacuum, the upper film 12 is positively attached to the lower film 1 by the pressure sensitive adhesive agent due to the vacuum suction force applied to the upper film.

Figure 13:
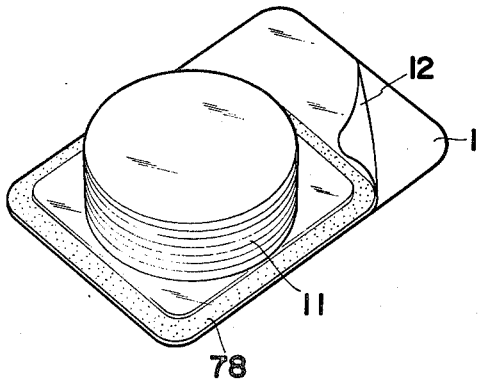
FIG. 13 is a perspective view showing a vacuum packaged material obtained in the embodiment of the present invention.

After packaging the plural materials between the upper and lower films under vacuum, these films are cut and trimed to provide a separate vacuum package as shown in FIG. 13.

Although the present invention has been described with reference to preferred embodiments thereof, many modifications and alterations may be made within the spirit and scope of the present invention.

What is claimed is:

1. A vacuum packaging method comprising:

intermittently supplying a continuous lower film;

placing material to be packaged on said lower film;

intermittently supplying a continuous upper film in a direction to form an acute angle relative to the direction of advancement of said lower film, said upper film having the characteristic of being expansible when softened by heat;

heating a portion of said upper film to form a softened upper film part;

applying suction to the upper surface of said softened part and thereby upwardly expanding said softened part to form an internal space slightly larger than the external shape of said material;

while said suction remains applied to said upper surface of said upper film, pressing the periphery of said softened and expanded part of said upper film against said lower film, and thereby enclosing said material between said lower film and said softened and expanded part of said upper film, while maintaining a narrow free space between said material and said softened and expanded part of said upper film; and vacuumizing said narrow free space and releasing said suction, and thereby causing said softened and expanded part of said upper film to be drawn toward said material and into close and simultaneous contact therewith.

2. A method as claimed in claim 1, wherein said step of applying said suction to upwardly expand said softened part is carried out while said softened part is heated.

3. A vacuum packaging method as claimed in claim 1, wherein said vacuumizing step is carried out through holes formed through said lower film around said material.

4. A vacuum packaging method as claimed in claim 1, wherein an adhesive agent is coated on said lower film around said material before said upper film is pressed against said lower film.

5. A vacuum packaging method as claimed in claim 1, wherein a pressurized air is supplied to said upper surface of said upper film during or after said narrow free space around said material between said upper and lower films is vacuumized.

6. A vacuum packaging method as claimed in claim 1, wherein said lower film is preliminarily heated before said upper film is pressed against said lower film.

7. A vacuum packaging apparatus comprising means for intermittently supplying a continuous lower film upon which a material to be packaged is placed, means for intermittently supplying a continuous upper film in a direction to form an acute angle relative to the advancing direction of said lower film, said upper film having the characteristic of being expansible when softened by heat, an upper vacuum box provided above said upper film and opened at the lower end thereof, said upper vacuum box having a heating means and a vacuum suction means therein, means for moving said vacuum box to an inclined position at which said lower end of said vacuum box becomes parallel to said upper film, and for descending said vacuum box to a position at which said upper film is pressed upon said lower film by said lower end of said vacuum box, and means for vacuumizing a space around said material between said upper and lower films.

8. A vacuum packaging apparatus as claimed in claim 7, wherein said heating means in said upper vacuum box comprises a stationary heating element and a movable heat plate, said heat plate being allowed to take a lower position, in which the lower surface thereof is substantially on the same level as said lower end of said upper vacuum box, and an upper position, in which a hollow space large enough to cover said material to be packaged is formed inside of said upper vacuum box.

9. A vacuum packaging as claimed in claim 8, wherein said vacuum suction means in said vacuum box comprises apertures extending through said heat plate, said apertures being connected with a vacuum source when said heat plate is moved upwardly.

10. A vacuum packaging apparatus as claimed in claim 7, wherein said vacuumizing means comprises a lower vacuum box provided below said lower film and a vacuum source which is connected with said space around said material to be packaged through said lower vacuum box and holes previously provided through said lower film, said lower vacuum box having an upper open end adapted to receive said lower end of said upper vacuum box, whereby when said upper vacuum box is descended, a part of the upper film at the lower end of said upper vacuum box is pressed against the lower film at the upper end of said lower vacuum box to confine said material between both said films inside of both said vacuum boxes.

11. A vacuum packaging apparatus as claimed in claim 7, wherein said upper vacuum box has a groove around the lower peripheral edge thereof, said groove being connected with a vacuum source to suck a part of said upper film at least when said upper vacuum box is descended.

12. A vacuum packaging apparatus as claimed in claim 10, further comprising means for forming said holes through said lower film around said material to be packaged.

13. A vacuum packaging apparatus as claimed in claim 7, wherein said supply means of said upper film has an extension roller for stretching said upper film and allowing said upper film to be drawn out of a supply roll while said upper vacuum box is at said inclined position and when said upper vacuum box is descended.

14. A vacuum packaging apparatus as claimed in claim 7, further comprising means for applying adhesive agent upon a part of said lower film to encircle said material to be placed on said lower film, said applying means including a transverse rod on which an applying member is mounted, said transverse rod being connected at both ends thereof to driving means and being guided to move in the transverse and lengthwise directions of said lower film.

15. A vacuum packaging apparatus as claimed in claim 8, further comprising heat conductive members provided at the inner periphery of said upper vacuum box to allow said heat plate to move within the inside of said heat conductive members.

16. A vacuum packaging apparatus as claimed in claim 10, further comprising a preliminary heating means for said lower film provided adjacent to said lower vacuum box.

17. A vacuum packaging apparatus as claimed in claim 15, wherein said heat conductive members have small passages adapted to be connected with said vacuum source.

* * * * *